US007544321B2

(12) United States Patent
Loebner et al.

(10) Patent No.: US 7,544,321 B2
(45) Date of Patent: Jun. 9, 2009

(54) PROCESS CONTAINER WITH COOLING ELEMENTS

(75) Inventors: Andreas Loebner, Herrenschwanden (CH); Reinhard Püllenberg, Aachen (DE)

(73) Assignees: Maerz-Ofenbau AG (CH); Berzelius Stolberg GmbH (DE)

( * ) Notice: Subject to any disclaimer, the term of this patent is extended or adjusted under 35 U.S.C. 154(b) by 373 days.

(21) Appl. No.: 10/558,356

(22) PCT Filed: May 27, 2004

(86) PCT No.: PCT/EP2004/005718

§ 371 (c)(1),
(2), (4) Date: Nov. 23, 2005

(87) PCT Pub. No.: WO2004/106831

PCT Pub. Date: Dec. 9, 2004

(65) Prior Publication Data

US 2006/0285572 A1 Dec. 21, 2006

(30) Foreign Application Priority Data

May 27, 2003 (DE) ..... 103 23 944

(51) Int. Cl.
*F28F 7/00* (2006.01)

(52) U.S. Cl. ..... 266/241; 373/76

(58) Field of Classification Search ..... 266/193, 266/194, 241; 373/76
See application file for complete search history.

(56) References Cited

U.S. PATENT DOCUMENTS

| | | | | |
|---|---|---|---|---|
| 3,843,106 | A | 10/1974 | Nanjyo | |
| 4,221,922 | A | 9/1980 | Okumune | |
| 4,453,253 | A * | 6/1984 | Lauria et al. | 373/76 |

FOREIGN PATENT DOCUMENTS

| | | | | |
|---|---|---|---|---|
| EP | 0 140 401 | | 5/1985 | |
| GB | 2 176 883 | | 1/1987 | |
| JP | 03070986 | A * | 3/1991 | 266/241 |
| JP | 05001315 | A * | 1/1993 | 266/241 |

* cited by examiner

*Primary Examiner*—Scott Kastler
(74) *Attorney, Agent, or Firm*—Robert W. Becker; Robert W. Becker & Assoc.

(57) ABSTRACT

A process container comprising a metallic casing having at least one refractory cladding layer disposed on the inner side thereof, and cooling elements connected to the outer side of the casing. Each cooling element comprises a base plate and at least one cooling channel connected to the base plate in a heat-conducting manner. The base plate is connected to the outer side of the casing by being screw connected to threaded bolts welded onto the outer side of the casing whereby the base plates nestle against the casing by flexural deformation due to clamping pressure of the screw connections. Ends of the cooling channels are connected to ends of adjacent cooling channels.

9 Claims, 2 Drawing Sheets

28
7
6
12
14
27
27
26
8
9
23
10
11
13

PROCESS CONTAINER WITH COOLING ELEMENTS

This specification for the instant application should be granted the priority date of May 27, 2003, the filing date of the corresponding German patent application 103 23 944.8 as well as the priority date of May 27, 2004, the filing date of the corresponding International patent application PCT/EP2004/005718.

BACKGROUND OF THE INVENTION

The invention relates to a process container with cooling elements and with at least one refractory cladding layer applied on the inner side of a metallic container casing, whereby each cooling element comprises a base plate and at least one cooling channel connected to this in a heat-conducting manner, the ends of which in each case exhibit a connection arrangement for the connection to the cooling channel of an adjacent cooling element.

The refractory claddings of metallic containers must be resistant to the effects of molten melts and slags, and also have an insulating effect, so that the container casing remains cool enough and therefore sufficiently load-bearing. The wear on the claddings, which is often considerable, can be reduced by cooling.

Cooling elements for electric melting furnaces are known, which form a substantial static constituent part of the container wall structure, inasmuch as they represent relatively large, rigid plate elements and are in fixed connection with the fire-resistant cladding layer applied directly on their inner side. Examples of such cooling elements can be found in U.S. Pat. No. 3,314,668, U.S. Pat. No. 4,221,922, WO 02/27042, or WO 02/081757. The dimensions of such a cooling element amount, for example, according to the details in said U.S. Pat. No. 4,221,922, to 1.71 m×6.10 m, and the thickness of its base plate 16 mm.

The frequently used cooling technique for the container wall by means of external water sprinkling has the disadvantage of water losses and the depositing of limescale and impurities. The principle is also known of welding cooling pipes onto the container casing. As a result of this, however, cracks may occur in the container casing, through which the cooling water penetrates into the cladding layer.

The invention is based on the object of providing a process container of the aforementioned type which can be manufactured with relatively low effort and therefore economically and can also be refurbishment of an existing process container, and which, due to a reduction of the wear on its refractory cladding, will allow for a longer period of operation until the next repair of the cladding.

SUMMARY OF THE INVENTION

This object is achieved according to the invention in that the cooling elements are secured to the outside of the container casing by screw connections, with in each case a threaded bolt welded to the outside of the container casing, so that, under the tensile pressure of the screw connections, the cooling elements nestle close to the container casing due to flexural deformation.

The metallic container casing of a metallurgical process container will in any event deviate from the theoretically ideal shape, e.g. cylindrical. The imperfections of the new component, not under load, are in most cases still quite small. However, if the container material is heated by the process heat, it expands. Because the casing temperature is not uniform due to the differing application and removal of heat, e.g. due to the inflow on one side due to air blast or the depositing of dust on individual areas, the degrees of expansion are different over the circumference. The casing will therefore necessarily deviate from the theoretical shape, e.g. cylindrical. Local bulging or indentations can be particularly large if limited damage to the refractory cladding has resulted in severe local overheating. While the imperfections incurred by manufacture are in the order of, for example, 1/1000 of the diameter of the casing, among containers of many years' operation shape deviations can be found in the range of 1/100 of the diameter. Other causes of such deformations of the casing of a process container can be: Weight loading due to the melts, load due to the displacement of the center of gravity, e.g. when tipping the vessel to empty out the melts, and/or support forces which take effect on the casing from the inside due to the expansion of the refractory cladding.

In the final analysis, account is to be taken of the expansions and shape changes of a metallic furnace casing or shell during commissioning and when shutting down, which are incurred by the high operating temperature. The cooling device described on the basis of the embodiment is well-suited for adapting to such changes in shape, and in this context of withstanding the high surface temperatures of, for example, a melting furnace for the refining of lead.

BRIEF DESCRIPTION OF THE DRAWINGS

Preferred embodiments of the invention are the object of the dependent patent claims, and can be derived from the following description on the basis of the drawings. In the drawings:

DESCRIPTION OF SPECIFIC EMBODIMENTS

Figure 1:
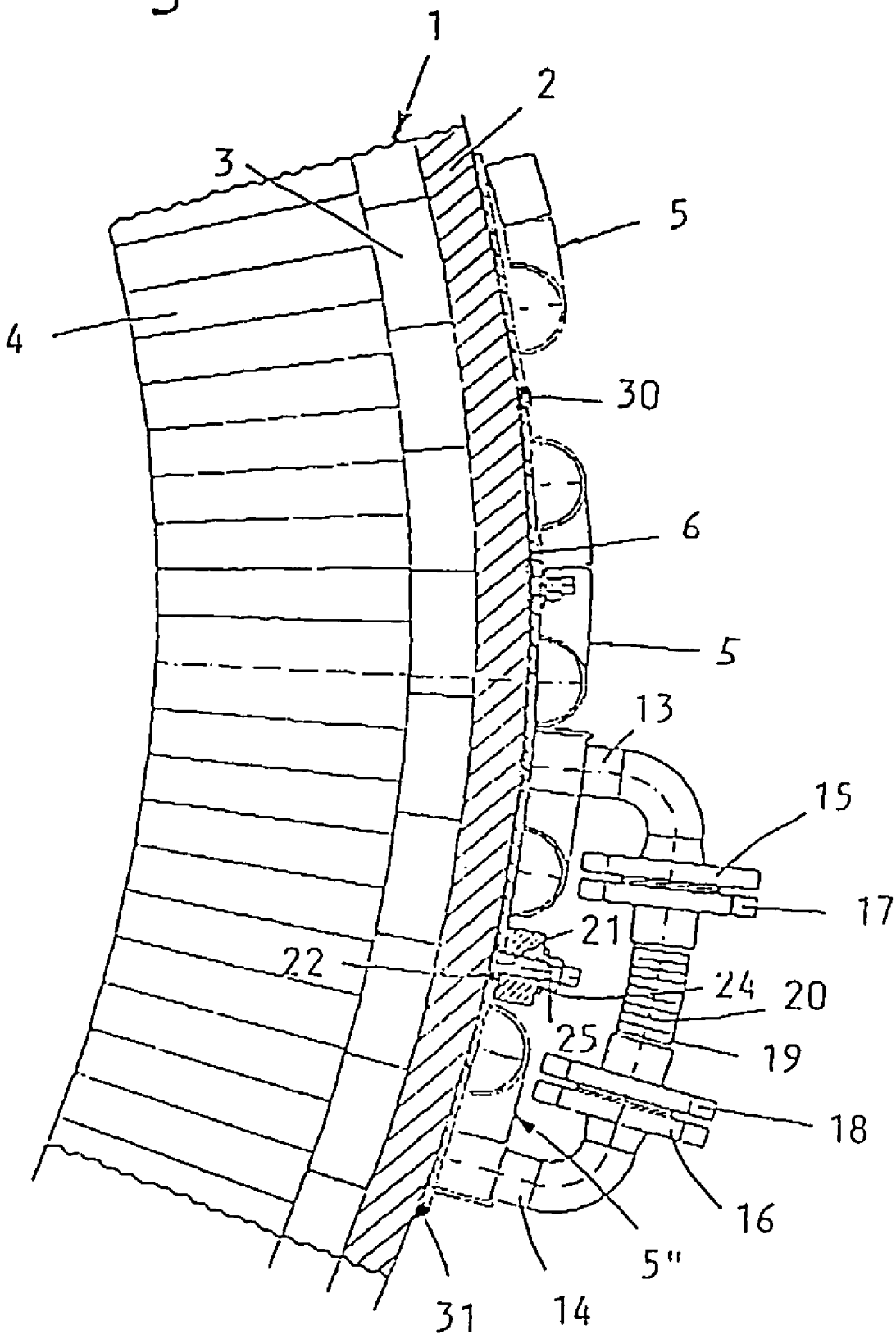
FIG. 1 shows a radial section through an area of a container casing equipped with cooling elements in accordance with FIG. 1.
Figure 2:
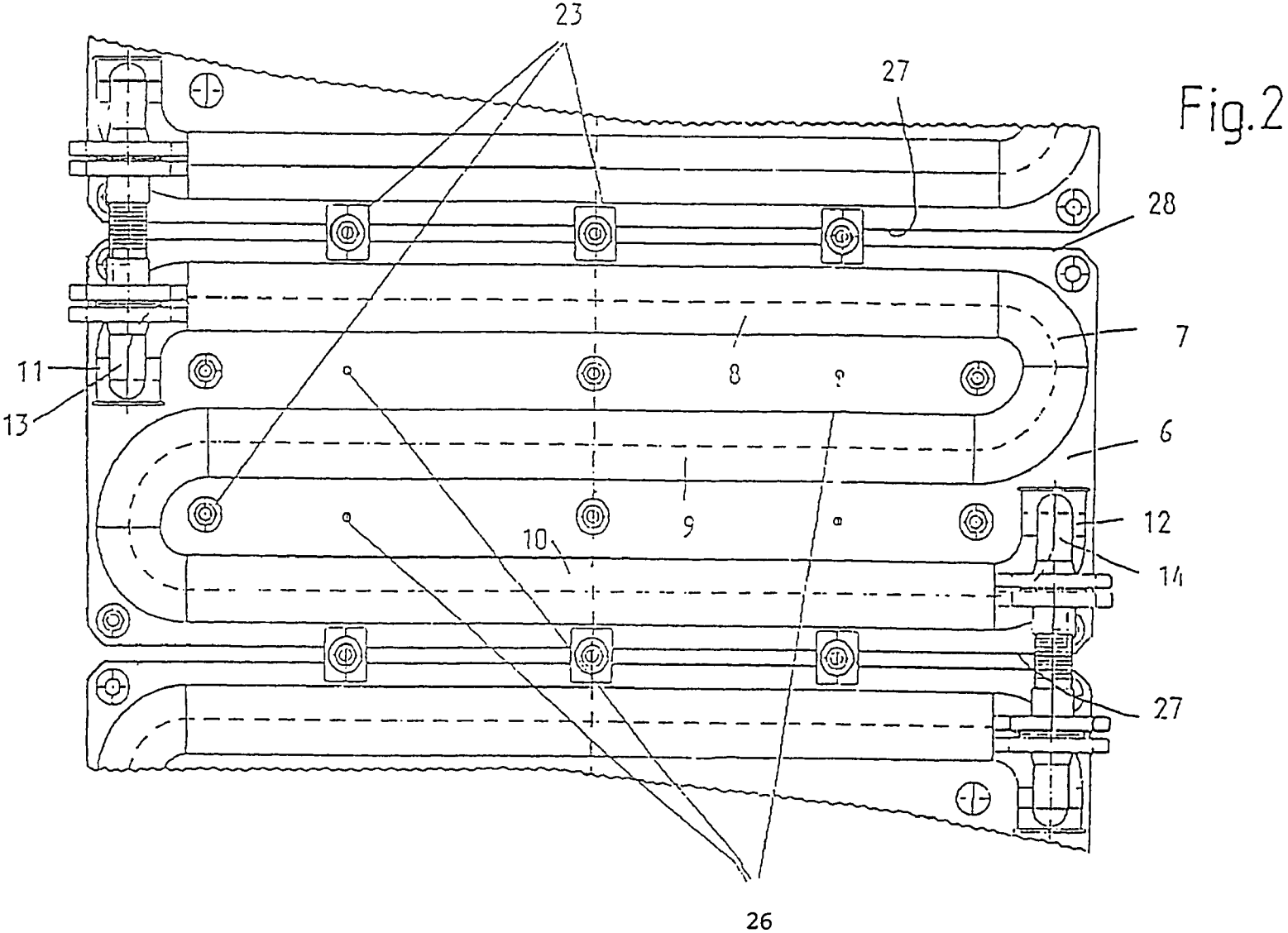
FIG. 2 shows a full plan view of a cooling element and a partial representation of two adjacent connected cooling elements of the same type, not completely represented.

The process container 1, by way of example cylindrical in shape, arranged standing or lying, has a container casing 2, shaped out of steel, which is protected against a highly-heated container content, e.g. a metal melt, by means of refractory cladding layers 3, 4. In order to increase the resistance of the cladding layers 3, 4 and the protection of the container casing 2 against overheating, a plurality of cooling elements 5, 5', 5", of the same design, are secured to the outside of the container casing 2.

Each cooling element 5, 5', 5", of which in each case, for example, twenty are arranged next to one another on a process container 1 with a diameter of, for example, 3 m, and a length of, for example, 25 m, in both the circumferential as well as the longitudinal direction, consists of a relatively thin and therefore flexible base plate 6, with a thickness of, for example, less than 5 mm, and preferably 3 or 4 mm, and at least one cooling channel 7, connected to this in a heat-conducting manner.

The cooling channel 7, with several runs, for example three, 8, 9, 10, and connecting 180° elbow bends, extends in a snaking or serpentine manner cambered along the outer side of the base plate 6 facing away from the container casing 2, over the largest possible part of its surface, in order to be in heat-conducting contact with this over a large surface area. It has, for example, the shell-form cross-section shape of a half-sectioned tube, which is welded to the base plate 6 along its sectional ends, so that the base plate 6 forms a part of the channel cross-section. It is also possible, however, for other cross-sectional shapes to be chosen, for which examples are cited by the previously mentioned U.S. Pat. No. 4,221,922.

For the connection to the cooling channel 7 of an adjacent cooling element 5, 5', 5", the two ends 11, 12 of the cooling channel 7 in each case have a connection arrangement which comprises a cambered connectors 13, 14, directed outwards away from the cooling element 5, 5', 5" or from the process container 1 respectively, with an end flange 15, 16, and a compensation pipe 19, exhibiting an end flange 17, 18 connecting the connectors 13, 14 of adjacent cooling elements 5, 5', 5". This pipe has a corrugated tube 20, so that imprecisions in the arrangement between adjacent cooling elements 5, 5', 5" and thermal expansion in the container casing 2 can be compensated for.

A detachable securing of the cooling elements 5, 5', 5" is provided by a plurality of threaded bolts 21, welded to the outside of the container casing 2, which extend through a number of bolt holes 22 provided at appropriate positions in the base plate 6, and also along the edges 27, 28 of the base plate 6 in a gap space between adjacent cooling elements 5, 5', 5". A pressure element 23, pushed on them in each case, which is substantially wider than the bolt holes 22, and a disk or cup spring 24, are tensioned by a lock nut 25, so that each base plate 6 is pressed with elastic preliminary tension at numerous points, according to the size of the pressure element 23, against the container casing 2, and due to flexural deformation nestles against the surface shape of the container casing 2. This deformability of the base plate 6 guarantees good adaptation to irregularities on the surface of the container casing 2, incurred for manufacturing reasons, and which also derive from the heating of the process container and its charge, with the result that an extensive heat-transferring contact is guaranteed between the cooling elements 5, 5', 5" and the container casing 2.

For further improvement of the heat transfer from the container casing 2 to the base plates 6 of the cooling elements 5, 5', 5", and therefore to the coolant fluid circulating in the cooling channels, provision is made in the preferred embodiment of the invention, between the container wall 2 and the base plate 6 of the cooling elements 5, 5', 5", for a heat-conductive paste, by means of which air gaps can be avoided or filled out, which would be unavoidable despite the relatively good ability of the cooling elements 5, 5', 5" to nestle against the container wall 2. The plastic deformability of the heat-conductive paste guarantees adaptation to changes in the shape or size of the filled-out gap as a consequence of the relative deformation between the base plate 6 and the container wall 2, as referred to, which arises during the operation of the process container. The elastic pre-tension of the screw securing also contributes to this, which is achieved by the disk springs 24 referred to.

In order to fill out or introduce a heat-conductive paste, available on the market from a number of manufacturers, between the container casing 2 and the base plate 6 in each case, threaded holes 26 are provided at several points in the base plate 6, into which the nipples of a paste press can be connected.

The introduction of the heat-conductive paste behind the base plate 6 of the cooling elements 5, 5', 5" is carried out, for example, until it emerges at the edges of the base plate 6. Gushing out of heat-conductive paste at the edges of the base plate 6 can, however, also be prevented or restricted to selected points, by the base plate 6 being sealed along its edges. Suitable for this is, for example, a hardening heat-conductive paste 30, 31, which is applied externally along the edges of the base plate 6, and in this situation can also fill out the gap space between adjacent cooling elements 5, 5', 5". The seal along the edges of the base plate 6 also allows for the use of a less tough heat-conductive paste, optimized in respect of its heat conducting properties, between the container casing 2 and the base plate 6 of the cooling elements 5, 5', 5".

The specification incorporates by reference the disclosure of German priority document 103 23 944.8 filed May 27, 2003 and PCT/EP2004/005718 filed May 27, 2004.

The present invention is, of course, in no way restricted to the specific disclosure of the specification and drawings, but also encompasses any modifications within the scope of the appended claims.

The invention claimed is:

1. A process container comprising:

a metallic casing having outwardly projecting threaded bolts welded onto an outer side thereof;

at least one refractory cladding layer disposed on an inner side of said casing;

cooling elements disposed on and connected to said outer side of said casing, wherein each cooling element comprises a metallic base plate disposed on said outer side of said casing and at least one cooling channel connected to said base plate in a heat-conducting manner, wherein said metallic base plate is configured to change in dimension under thermal stress and conform to dimensional changes of said casing, wherein said base plate is connected to said outer side of said casing by being screw connected to said threaded bolts of said casing such that said base plate of said cooling element nestles against said casing by flexural deformation due to clamping pressure of the screw connections; and means for connecting ends of one of said cooling channels to ends of an adjacent one of said cooling channels, wherein said threaded bolts are distributed over an entire surface of a respective cooling element and not only along edges of the cooling element, wherein said threaded bolts extend through bolt holes provided in said base plate, and wherein said threaded bolts extend along edges of said base plate.

2. A process container according to claim 1, wherein said screw connections are effected in a resilient manner by means of disk springs that are placed on said threaded bolts.

3. A process container according to claim 1, wherein a heat-conductive paste is disposed between said casing and said base plate of said cooling element.

4. A process container according to claim 3, wherein a plurality of filling holes are distributed over said base plate of said cooling element for said heat conductive paste.

5. A process container according to claim 1, wherein each of said cooling elements is provided with a cooling channel that extends over said base plate in a serpentine manner via at least two runs, wherein said cooling channel is in the form of a hollow profile that is open on one side, and wherein edges of said hollow profile of said cooling channel are welded with said base plate.

6. A process container according to claim 1, wherein said means for connecting said ends of said cooling channel include an outwardly directed connector at each of said ends of said cooling channel, and wherein said connectors of adjacent ones of said cooling elements are interconnected by a compensation pipe that is provided with a corrugated tube.

7. A process container according to claim 1, wherein said base plate has a thickness of less than 5 mm.

8. A process container according to claim 1, wherein said base plate is provided with an edge seal along a periphery of said base plate, and wherein a heat-conducting paste is provided between said casing and said base plate.

9. A process container according to claim 8, wherein said edge sea is comprised of a hardening heat conductive paste.

* * * * *